US009802788B2

(12) United States Patent
Miyajima et al.

(10) Patent No.: US 9,802,788 B2
(45) Date of Patent: Oct. 31, 2017

(54) ELEVATOR SECURITY SYSTEM INCLUDING A CREDENTIAL TRANSMITTED TO A USER

(75) Inventors: Natsuki Miyajima, Chiba (JP); Norbert Antony Murray Hootsmans, South Glastonbury, CT (US); Muneo Ikeda, Chiba-ken (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 349 days.

(21) Appl. No.: 14/403,273

(22) PCT Filed: Jun. 22, 2012

(86) PCT No.: PCT/US2012/043663

§ 371 (c)(1),
(2), (4) Date: Nov. 24, 2014

(87) PCT Pub. No.: WO2013/191703

PCT Pub. Date: Dec. 27, 2013

(65) Prior Publication Data

US 2015/0158696 A1 Jun. 11, 2015

(51) Int. Cl.
*B66B 1/20* (2006.01)
*B66B 1/34* (2006.01)
(Continued)

(52) U.S. Cl.
CPC ..... *B66B 1/3461* (2013.01); *B66B 1/2408* (2013.01); *B66B 1/468* (2013.01);
(Continued)

(58) Field of Classification Search
CPC ..... B66B 5/0012; B66B 1/3461; B66B 1/468; B66B 1/2408; B66B 2201/4638; B66B 2201/4653; B66B 2201/4676
(Continued)

(56) References Cited

U.S. PATENT DOCUMENTS 5,858,945 A * 1/1999 Lang ..... C11D 3/2086 252/186.25
6,011,839 A * 1/2000 Friedli ..... B66B 1/462 187/384
(Continued)

FOREIGN PATENT DOCUMENTS

JP 2011051718 3/2011
WO 2008046173 4/2008
(Continued)

OTHER PUBLICATIONS

International Preliminary Report on Patentability for International application No. PCT/US2012/043663 dated Dec. 31, 2014.
(Continued)

*Primary Examiner* — Anthony Salata
(74) *Attorney, Agent, or Firm* — Carlson, Gaskey & Olds

(57) ABSTRACT

An elevator security system for a building includes data relating to a floor that a user may access in the building, a device in which the data is stored, a credential containing the data in a machine readable format and created by the user, and a first machine reader reading the credential and sending data therein to the device for querying whether the user may access the floor, the device allowing access to an elevator car for transport to the floor if the credential is in sync with the data stored in the device.

23 Claims, 2 Drawing Sheets

(51) Int. Cl.
*B66B 1/46* (2006.01)
*B66B 1/24* (2006.01)

(52) U.S. Cl.
CPC ..... *B66B 2201/4638* (2013.01); *B66B 2201/4653* (2013.01); *B66B 2201/4676* (2013.01)

(58) Field of Classification Search
USPC ..... 187/247, 277, 380–389, 391, 395, 396
See application file for complete search history.

(56) References Cited

U.S. PATENT DOCUMENTS 6,209,685 B1 4/2001 Zaharia et al.
6,707,374 B1 * 3/2004 Zaharia ..... B66B 1/468 187/392
7,581,622 B2 * 9/2009 Amano ..... B66B 1/18 187/384
7,823,700 B2 * 11/2010 Boss ..... B66B 1/468 187/247
7,936,249 B2 5/2011 Friedli
8,061,485 B2 * 11/2011 Finschi ..... B66B 1/468 187/384
8,091,687 B2 * 1/2012 Hamaji ..... B66B 1/468 187/384
8,490,754 B2 * 7/2013 Amano ..... B66B 1/2458 187/384
8,813,917 B2 * 8/2014 Salmikuukka ..... B66B 1/468 187/247
8,857,569 B2 * 10/2014 Friedli ..... B66B 5/0012 187/384
8,910,752 B2 * 12/2014 Furutani ..... B66B 1/468 187/384
8,944,219 B2 * 2/2015 Gerstenkorn ..... B66B 1/468 187/384
9,323,232 B2 * 4/2016 Blom ..... G05B 13/00
2011/0035604 A1 2/2011 Habraken
2014/0305747 A1 * 10/2014 Kumar ..... B66B 1/468 187/381
2015/0217969 A1 * 8/2015 Flynn ..... B66B 1/468 187/380
2016/0009525 A1 * 1/2016 DePaola ..... B66B 1/468 187/380
2016/0096706 A1 * 4/2016 Tang ..... B66B 1/468 187/247
2016/0152439 A1 * 6/2016 MacDonald ..... B66B 1/46 187/384
2016/0188899 A1 * 6/2016 Stanley ..... G06F 21/31 726/19
2016/0267731 A1 * 9/2016 Stanley ..... B01L 3/0293

FOREIGN PATENT DOCUMENTS

WO 2008046173 A1 4/2008
WO 2011/141627 A1 11/2011

OTHER PUBLICATIONS

International Search Report and Written Opinion of the International Searching Authority for International application No. PCT/US12/43663 dated Apr. 11, 2013.
Examination Report under Section 18(3) for Application No. GB1500976.4 dated Jun. 1, 2017.

* cited by examiner

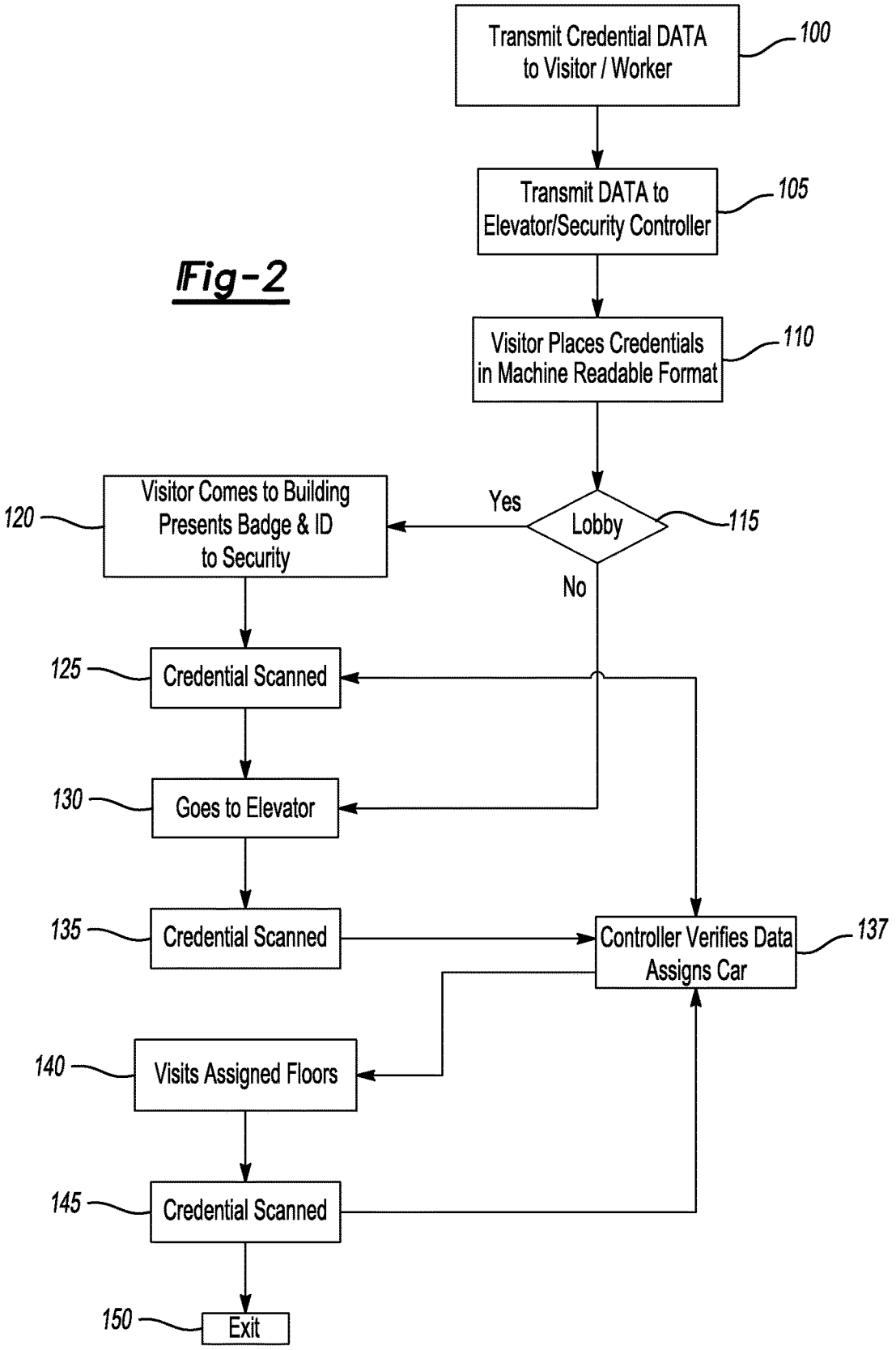
Fig-2
Transmit Credential DATA to Visitor / Worker
100
Transmit DATA to Elevator/Security Controller
105
Visitor Places Credentials in Machine Readable Format
110
Lobby
115
Yes
No
Visitor Comes to Building Presents Badge & ID to Security
120
Credential Scanned
125
Goes to Elevator
130
Credential Scanned
135
Controller Verifies Data Assigns Car
137
Visits Assigned Floors
140
Credential Scanned
145
Exit
150

ELEVATOR SECURITY SYSTEM INCLUDING A CREDENTIAL TRANSMITTED TO A USER

TECHNICAL DETAILS

This system relates to elevator security systems and more particularly to security systems which have fixed serviceable floor information disposed in a machine readable form.

BACKGROUND

Building security systems are becoming increasingly more important. Many buildings have sign-in stations, security guards, machine readable security credentials, smart turnstiles that manage the count of people entering and leaving a building, video surveillance, and more.

Businesses disposed in buildings would prefer that only people who are entitled to be on the floors that they inhabit be populated with people who have permission to be there. Moreover, many high rises have elevators which open directly into residences or secured areas.

SUMMARY

According to an embodiment disclosed herein, an elevator security system for a building includes data relating to a floor that a user may access in the building, a device storing the data, a credential transmitted to the user, the credential allowing the user to use the data to access the floor, and a first machine reader reading the credential for querying the device whether the user may access the floor, the device providing access to an elevator car for transport to the floor if the credential is in agreement with the data stored in the device.

Additionally or alternatively in this or other arrangements, the data also includes the date a user may access the building wherein the device verifies that the user is at the building at the date if the machine reader scans the credential.

Additionally or alternatively in this or other arrangements, the data also includes the times a user may access the building if the machine reader scans the credential wherein the device verifies that the user is at the building at the times.

Additionally or alternatively in this or other arrangements, the data also includes alternative users.

Additionally or alternatively in this or other arrangements, the first machine reader is disposed at a security station.

Additionally or alternatively in this or other arrangements, a second machine reader is disposed at a first elevator landing.

Additionally or alternatively in this or other arrangements, a third machine reader is disposed at a second elevator landing.

Additionally or alternatively in this or other arrangements, the first machine reader is disposed at a first elevator landing.

Additionally or alternatively in this or other arrangements, the second machine reader is disposed at a second elevator landing.

Additionally or alternatively in this or other arrangements, the device maintains a count of elevator usage by said user.

Additionally or alternatively in this or other arrangements, the data is also stored in the credential.

Additionally or alternatively in this or other arrangements, a reference to the data is stored in the credential.

Additionally or alternatively in this or other arrangements, the credential is a bar code, a data matrix or an RFID tag.

Additionally or alternatively in this or other arrangements, the credential is displayed on a personal data assistant.

According to a further embodiment disclosed herein, sending a credential electronically to a user of a building, sending data as to a first floor that user may utilize in said building to a device for said building, placing said credential in a machine readable format remote from said building, automatically reading said machine readable format at said building and submitting the machine readable format to said device that sends an elevator car to deliver said user to said first floor if said read machine readable format is in agreement with said data.

Additionally or alternatively in this or other arrangements, the method further includes the step of verifying the user's identity before allowing access to an elevator.

Additionally or alternatively in this or other arrangements, the method further includes the step of automatically reading the data in a machine readable format at a security station.

Additionally or alternatively in this or other arrangements, the method further comprises sending data as to a date a user may access the floor and the times of the day a user may access the floor on the date.

Additionally or alternatively in this or other arrangements, the method further includes the step of reading the data in machine readable format at the first floor, and allowing the user to go to a second floor in an elevator if the data in machine readable format is in sync with data in the device.

Additionally or alternatively in this or other arrangements, the method includes the further step of maintaining a count of elevator usage by the user.

Additionally or alternatively in this or other arrangements, the method further comprises sending said data within said credential.

Additionally or alternatively in this or other arrangements, the method further comprises sending a reference to said data within said credential.

According to a further embodiment disclosed herein, an elevator system includes data relating to a floor that a user may access in the building, a device storing the data, a credential transmitted to the user, the credential allowing the user to use the data to access the floor, and a first machine reader reading the credential for querying the device whether the user may access the floor, the device assigning an elevator car for transport to the floor if the credential is in agreement with the data stored in the device.

BRIEF DESCRIPTION OF THE DRAWINGS

FIG. 2 is a diagram of a process used to practice the system shown in FIG. 1.

DETAILED DESCRIPTION OF THE INVENTION

Figure 1:
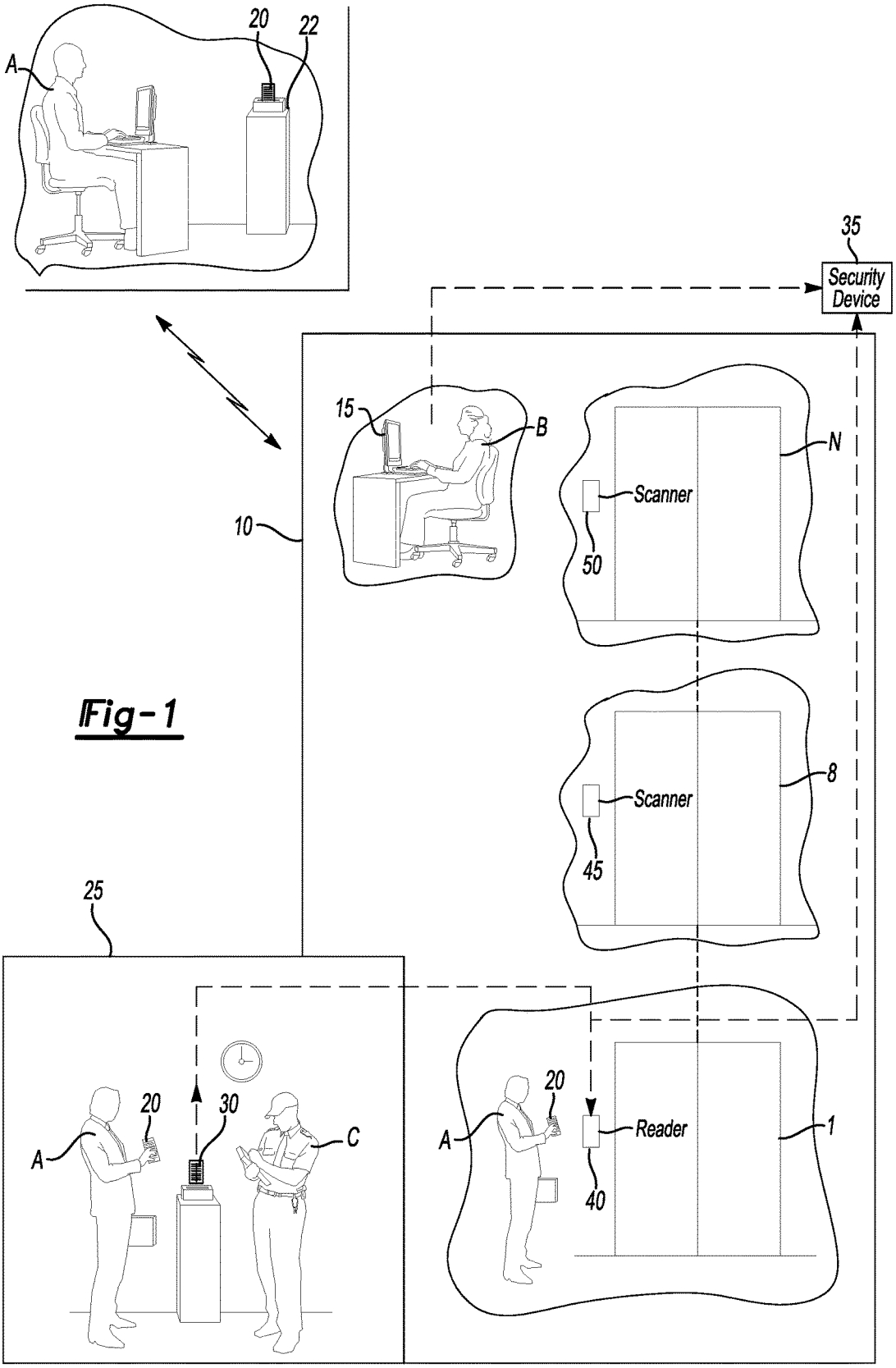
FIG. 1 relates to a building in which the security system described herein is utilized.

Referring now to FIG. 1, if person A and person B wish to have person A visit or work in building 10 they communicate with each other. Person A may be a vendor, a customer, a visitor, a salesperson or the like. Person B then enters a computer terminal 15 and enters information into that terminal relative to Person A's business in the building 10. Such information may include floors that Person A may visit, dates in which those floors may be accessed, persons that may be able to take Person A's place, groups of people, times during the day which that person(s) may enter building, times when Person A may access each designated floor, a business name etc. This information is hereafter referred herein as DATA.

The DATA is then transmitted electronically to Person A, via the internet or other suitable means, who creates or prints it out as a credential 20 in a machine readable, two-dimensional format, such as a bar code or as a data matrix, on printer 22 or uses a personal data assistance mechanism or the like to enable display or other transmission of the credential electronically. This two-dimensional format may also be faxed to Person A. Should technology allow it, other machine readable or discernible formats like RFID tags, 3D matrices, or the like may be substituted for the two-dimensional formats. The DATA is also sent to and entered into an elevator/security device 35 by the internet or the like. Person A may have his or her name unencrypted on the credential 20. Person A may be at a location remote from building 10. The device 35, which is shown as an elevator/security system controller, may also comprise separate security and elevator control systems that cooperate with each other. The scanners 30 and 40 may also be other types of readers, such as RF readers and others depending on the type of the credential 20 issued as noted above.

As an alternative, the DATA may be maintained in the elevator/security device 35 and a Reference to the DATA may be transmitted to the Person A and downloaded as a credential as stated hereinabove. If the Person A then approaches the building, the Reference, if transmitted to the device 35, which may be a part of an elevator controller, then calls up the DATA for use as discussed herein infra.

At the appointed time and date, User A proceeds to the lobby 25 of the building 10, Security Guard C verifies the User A's identification and scans/reads the credential 20 with scanner 30. Scanner 30 queries the device 35 and gets approval or denial therefrom that the Person A is at building 10 at the proper time and date if the data in the credential 20 is in agreement (e.g., there is a handshake between the data fields and the input data) with the DATA. The device 35 may also assign an elevator car at first floor landing 1 at this point and be directed to that first floor landing 1 by the Guard C. If the credential 20 holds the Reference to the DATA, the device 35 transmits data as to who is the appropriate User A to Security Guard C for verification or User A by the Security Guard C. One of ordinary skill in the art will recognize that the Security Guard C may be any human or electronic sentinel that can verify the credential 20 and/or the identity of User A.

User A then takes credential 20 and scans it at a hall scanner 40 that may be the assigned first floor landing 1. The device 35 then sends an elevator car to the first floor landing 1. If the Person A does not have permission to enter the car at the first floor landing guard C may be summoned to the first floor landing 1.

In the invention as shown, Person A is given permission to travel to floor landing 8 and an elevator car is dispatched to pick up User A at first floor landing 1 to take User A to either floor landing 8 or floor landing N as permitted by the DATA encrypted in the credential 20. The device 35 will only allow the elevators to take that User A to those floors within the time frames and dates specified. If the User A wishes to travel between floor landing 8 and floor landing N for instance, the hall scanner 45 reads the credential 20 to allow the user to go to either first floor landing 1 or floor landing N. Similarly, if the user is at floor landing N, the hall scanner 50 will allow the user to go to either floor landing 8 or first floor landing 1.

If the building 10 has no lobby 25, the user may go directly to hall scanner 40 which, after scanning the credential 20, queries the device 35 that accepts or denies access (via a turnstile or a locked door, both not shown, or the like) and assigns a car to pick up the Person A to send them to the applicable floors on the applicable dates as noted herein above.

By limiting the travel of Person A to the floors as designated, locked hallway doors to offices may be eliminated thereby freeing up valuable space, because people who have an invitation to those floors, will come to those floors.

Referring now to FIG. 2, a method of using the embodiment shown in FIG. 1 is shown. In step 100, a person who wishes another to visit or work in building 10 transmits user credential, which may include DATA or a Reference thereto to the visitor/worker/user Person A. Simultaneously, or after step 100, the data is transmitted to an elevator/security device 35 where the data is entered (step 105).

In step 110, the visitor prints, replicates or otherwise places the DATA in a machine readable format or transfers the DATA to a personal data assistance to display a credential 20 and the user moves towards the building 10 at the appointed date and time. In step 115, Person A determines whether there is a secured lobby 25. If there is, Person A comes to the lobby 25, presents the credential 20 and ID to the security guard C while the data is scanned (step 125) by querying device 35 to confirm Person A's identity and the date and time of access. Optionally the querying device may be located at a security door or turnstile. Upon confirmation of the credential the security door or turnstile may be unlocked to allow access. An elevator may also be assigned at this time. The car assignment may be displayed on screen located near the security door, turnstile or on the PDA device itself.

If there is no lobby, Person A, as with the user who has to go through security in steps 120 and 125, goes to the elevator first floor landing 1 in step 130. In step 135, the credential 20 in the machine readable format is scanned and a car assigned to the Person A if the data in the credential 20 is in agreement with the DATA, and a count is made. In step 137, the device 35 verifies the data in the credential 20 is proper and assigns a car for the user if the data is verified. The device maintains a count of where Person A is, and at what times, to further enhance security of the building.

Person A then visits an assigned floor in step 140. Should Person A wish to change floors, the credential 20 is scanned again at a landing scanner (e.g., as an example at landing on floor landing 1, 8 or N) 40, 45, or 50. The device then verifies the data and assigns a car to take the visitor to the assigned floor. The assigned floor may be the exit floor at landing 1. In addition, the Person A may go to other floor landings or no other floor landings depending on permission given by Person B.

If a group of persons is allowed access, person B may create DATA which contains information of a guest group with individual IDs for each member of the group. The group, for example, may not access an elevator by only their individual IDs. The device 35 may allow the guest group to access an elevator if ALL guests' ID were verified. One of ordinary skill in the art will recognize that there are many permutations of allowance a guest group may have.

Although embodiments of this invention have been disclosed, a worker of ordinary skill would recognize that certain modifications would come within the scope of this invention. For that reason, the following claims should be studied to determine the true scope and content of this invention.

What is claimed is:

1. An elevator security system for a building comprising:

data relating to a floor that a user may access in said building, a device storing said data, a credential transmitted electronically to said user, said credential allowing said user to place said credential in a machine readable format and use said data to access said floor, and a first machine reader reading said credential in the machine readable format for querying said device whether said user may access said floor, said device providing access to an elevator car for transport to said floor if said credential is in agreement with said data stored in said device, wherein said user is a first distance from the first machine reader when the credential is transmitted to the user, and the user is a second distance from the first machine reader when the first machine reader reads the credential, the second distance being less than the first distance.

2. The system of claim 1 wherein said data also comprises a date a user may access said building wherein said device verifies that said user is at said building at said date if said machine reader reads said credential.

3. The system of claim 1 wherein said data also comprises the times a user may access said building if said machine reader reads said credential wherein said device verifies that said user is at said building at one of said times.

4. The system of claim 1 wherein said data also comprises alternative users.

5. The system of claim 1 wherein said first machine reader is disposed at a security station.

6. The system of claim 5 wherein a second machine reader is disposed at a first elevator landing.

7. The system of claim 6 wherein a third machine reader is disposed at a second elevator landing.

8. The system of claim 1 wherein said first machine reader is disposed at a first elevator landing.

9. The system of claim 8 wherein said second machine reader is disposed at a second elevator landing.

10. The system of claim 1 wherein said device maintains a count of usage by said user.

11. The system of claim 1 wherein said data is also stored in said credential.

12. The system of claim 1 wherein a reference to said data is stored in said credential.

13. The system of claim 1 wherein said machine readable format comprises a bar code, a data matrix, or an RFID tag.

14. The system of claim 1 wherein said credential is displayed on a personal data assistant.

15. An elevator security method comprising the steps of:

sending a credential electronically to a user of a building when said user is a first distance from a credential reader, sending data as to a first floor that said user may utilize in said building to a device for said building, placing said credential in a machine readable format remotely from said building, automatically reading said machine readable format with a credential reader at said building when the user is a second distance from the credential reader, the second distance being less than the first distance, and submitting the read machine readable format to said device that assigns an elevator car to deliver said user to said first floor if said read machine readable format is in agreement with said data.

16. The method of claim 15 further comprising the step of:

verifying said user's identity before allowing access to an elevator.

17. The method of claim 16 further comprising the step of:

automatically reading said data in a machine readable format at said credential reader.

18. The method of claim 15 further comprising sending data as to a date a user may access said floor and the times of the day a user may access the floor on said date.

19. The method of claim 15 further comprising reading said data in machine readable format at said first floor, and allowing said user to go to a second floor in an elevator if said data in machine readable format is in agreement with data in said device.

20. The method of claim 15 further comprising the step of maintaining a count of elevator usage by said user.

21. The method of claim 15 further comprising sending said data within said credential.

22. The method of claim 15 further comprising sending a reference to said data within said credential.

23. An elevator system comprising:

data relating to a floor that a user may access in said building, a device storing said data, a credential transmitted electronically to said user, said credential allowing said user to place said credential in a machine readable format and use said data to access said floor, and a first machine reader reading said credential in the machine readable format for querying said device whether said user may access said floor, said device assigning an elevator car for transport to said floor if said credential is in agreement with said data stored in said device, wherein said user is a first distance from the first machine reader when the credential is transmitted to the user, and the user is a second distance from the first machine reader when the first machine reader reads the credential, the second distance being less than the first distance.

* * * * *